US006308030B1

(12) United States Patent
Taylor et al.

(10) Patent No.: US 6,308,030 B1
(45) Date of Patent: Oct. 23, 2001

(54) METHOD AND APPARATUS FOR SUPPORTING A DRUM FOR LOADING AND UNLOADING FROM A COPIER AND/OR PRINTER APPARATUS

(75) Inventors: Randall J. Taylor, Bergen; Donald C. Buch; Andreas G. Nagy, both of Rochester, all of NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/575,043

(22) Filed: May 19, 2000

(51) Int. Cl.[7] ..... G03G 15/00

(52) U.S. Cl. ..... 399/121; 399/107; 399/117; 101/216

(58) Field of Search ..... 399/107, 108, 399/110, 116, 117, 121, 122, 124, 167, 302, 308; 101/216, 218

(56) References Cited

U.S. PATENT DOCUMENTS 5,060,569 * 10/1991 Gladow ..... 101/216
6,075,965 6/2000 Tombs et al. ..... 399/308
6,115,568 * 9/2000 Sameshima ..... 399/110
6,142,073 * 11/2000 Zeman et al. ..... 101/216

OTHER PUBLICATIONS

U.S. Patent Application Serial No. 09/474,352, filed Dec. 29, 1999.
U.S. Patent Application Serial No. 09/575,044, filed May 19, 2000.
U.S. Patent Application Serial No. 09/575,077, filed May 19, 2000.

* cited by examiner

*Primary Examiner*—Arthur T. Grimloy
*Assistant Examiner*—Hoang Ngo
(74) *Attorney, Agent, or Firm*—James D. Leimbach

(57) ABSTRACT

A roller assembly used for printing is loaded into a printing apparatus by supporting the roller assembly in a loading tool having a first carriage with top and bottom rows of rollers, the rollers engaging rails on the roller assembly and the first carriage being oriented with a second carriage within the apparatus. The second carriage also has top and bottom rows of rollers oriented similarly with the rollers of the first carriage. The roller assembly is moved into the carriage so that rails of the roller assembly are engaged by the rollers of the carriage in the printer apparatus.

6 Claims, 10 Drawing Sheets

METHOD AND APPARATUS FOR SUPPORTING A DRUM FOR LOADING AND UNLOADING FROM A COPIER AND/OR PRINTER APPARATUS

Cross-Reference to Related Applications Filed Concurrently Herewith

U.S. patent application Ser. No. 09/575,044, filed May 19, 2000, entitled "METHOD AND APPARATUS FOR MOVING A DRUM INTO A NIP".

U.S. patent application Ser. No. 09/575,077, filed May 19, 2000, entitled "METHOD AND APPARATUS FOR APPLYING A CONSTANT LOAD TO A ROLLER".

Background of the Invention

1. Field of the Invention

The invention relates to electrostatography and more particularly to a method and apparatus for applying a loading force to a roller used in image transfer.

2. Background of the Invention

In U.S. application Ser. No. 900,696 filed in the name of Tombs et al (the contents of which are incorporated herein by reference) there is disclosed an electrophotographic reproduction apparatus wherein a series of roller separation image forming stations are arranged so that a receiver sheet may be conveyed from station to station to receive color separation images in transfer so that the images are superposed onto each other to form a composite multicolor image. In the aforesaid application at each color separation station a compliant intermediate transfer drum or roller (ITR) has an electrically conductive core of for example aluminum, a relatively thick (1–20 mm) compliant blanket layer is around the core and a relatively thin (2 micrometers–30 micrometers) hard overcoat layer surrounds the blanket layer. The Young's modulus of the blanket layer is preferably between 0.1 MPa and 10 MPa, and the blanket layer has a bulk volume electrical resistivity preferably between $10^7$–$10^{11}$ ohm-cm. The Young's modulus of the overcoat layer is preferably greater than 100 MPa. The ITR forms a nip under pressure with a photoconductive (PC) drum. An electrical bias is impressed upon the ITR of suitable level and polarity to urge a developed toner image on the PC drum to transfer to the surface of the ITR. A receiver sheet is then moved into a second nip between the ITR and a paper transfer roller (PTR) in a timed or registered condition to receive the image in transfer from the ITR. An electrical bias of appropriate level and polarity is provided to the PTR to urge transfer of the toner image to the receiver sheet.

Heretofore, a PC drum and ITR were urged together by controlling the separation of their respective axes and establishing a predetermined interference in their respective radii of which interference is accommodated by the compliancy in the ITR blanket layer. However, this solution is not desirable because accommodation must be made when the machine is not producing prints to separate the PC drum from the ITR to avoid set forming in the ITR.

A further problem arises in attempting to load or unload relatively heavy rollers.

It is an object of the invention to provide a method and apparatus which provides for an improved manner of loading and for unloading a printing roller or drum assembly to or from the printing apparatus.

SUMMARY OF THE INVENTION

In accordance with the first aspect of the invention there is provided for use with a printing apparatus having a roller assembly used for printing, a method of loading the roller assembly into the printing apparatus, the method comprising: supporting the roller assembly in a loading tool having a first carriage with top and bottom rows of rollers, the rollers engaging rails on the roller assembly and the first carriage being oriented with a second carriage within the apparatus, the second carriage also having top and bottom rows of rollers; and moving the roller assembly into the machine so that rails of the roller assembly are engaged by the rollers of the carriage in the printing apparatus.

In accordance with a second aspect of the invention there is provided a loading tool for loading a roller used in a printing apparatus, the loading tool comprising: a frame and a carriage supported within the frame, the carriage comprising a set of top and bottom rows of rollers oriented to match an orientation of a similar set of rollers of a carriage in the printing apparatus.

In accordance with a third aspect of the invention there is provided for use with a printing apparatus having a roller assembly used for printing, a method of loading the roller assembly into the printing apparatus, the method comprising: supporting the roller assembly in a loading tool having a first carriage with roller assembly supporting elements of the first carriage having a predetermined orientation; providing a second carriage within the apparatus having roller assembly supporting elements similar to that of the first carriage, the orientation of the roller assembly supporting elements of the second carriage being adjustable and adjusting the orientation of the second carriage to adjust the elements of the second carriage to that of the elements of the first carriage; and moving the roller assembly into the machine so that the roller assembly is engaged by the supporting elements of the carriage in the printing apparatus.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENTS

Figure 1:
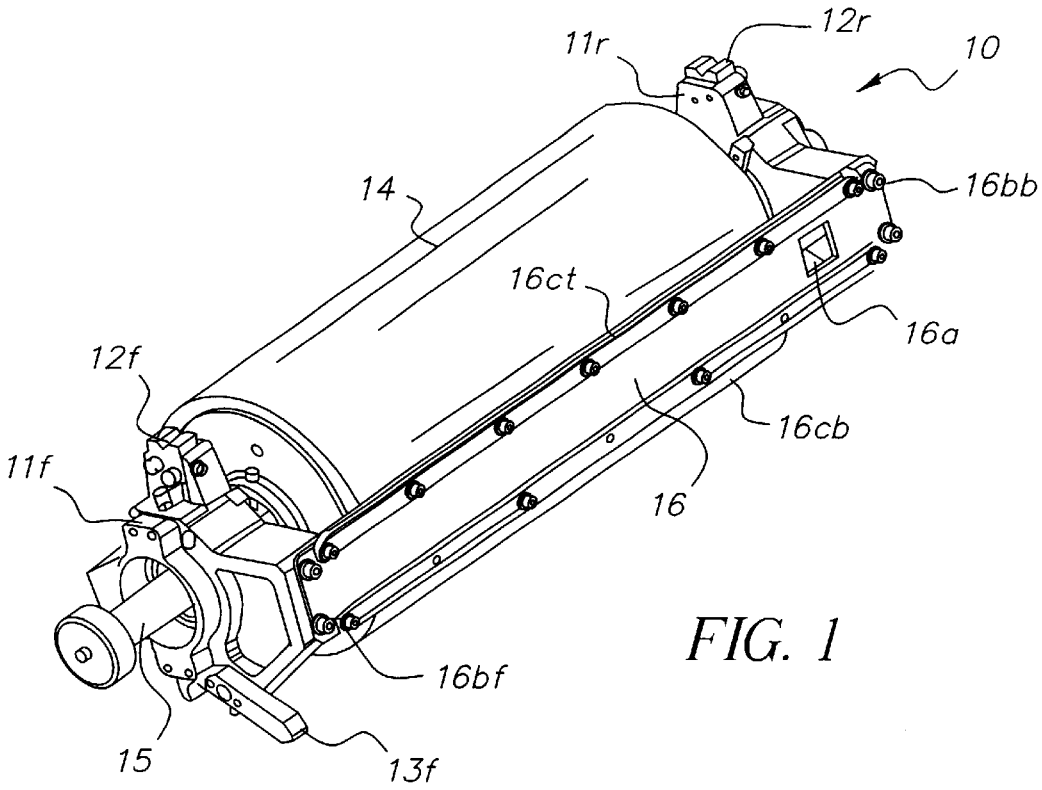
FIG. 1 is a perspective view of an intermediate transfer roller or drum (ITR) assembly in accordance with the invention.

The present invention is described below in the environment of an electrophotographic copier and/or printer. However, it will be noted that, although this invention is suitable for use with such machines it can also be used with other types of electrostatographic copiers and/or printers, such as those which employ electrographic writers as well as with other printing apparatus.

Because apparatus of the general type described herein are well known, the present description will be directed in particular to elements forming part of, or cooperating more directly with, the present invention. An exemplary image forming reproduction apparatus, as described in Tombs et al, that may include a primary image forming member, for example, a photoconductive drum having a photoconductive surface on which a pigmented marking particle image, or a series of different color marking particles images, is formed. In order to form images, the outer surface of the photoconductive drum is uniformly charged by a primary charger such as a corona charging device or other suitable charger such as roller chargers, brush chargers, etc. The uniformly charged surface is exposed by suitable exposure means, such as, for example, a laser or LED or other electro-optical exposure device, or even an optical exposure device for selectively altering the charge on the surface of the drum to create an electrostatic image corresponding to an image to be reproduced. Electrostatic images are developed by application of pigmented marking particles to the image bearing photoconductive drum by a development station. Marking particle images are transferred to the outer surface of the secondary or intermediate image transfer member, for example, an intermediate transfer drum. The intermediate transfer drum, as noted above, includes a metallic conductive core and compliant layer. The compliant layer is formed of an elastomer such as polyurethane or other materials which have been doped with sufficient conductive material (such as antistatic particles, ionic conducting materials, or electrically conducting dopants) to have a relatively low resistivity. As noted in Tombs et al, a series of color producing modules may be provided, each of which modules includes a primary image forming member such as a photoconductive drum and a respective intermediate transfer member that is associated with that primary image forming member for transferring the toner image from the primary image forming member to the transfer member and then from the transfer member to a receiver sheet which is moved from module to module. The movement of a receiver member, which may be assisted in case of a receiver sheet, by a transport web is such that each color image transfer to the receiver member at the transfer of each module formed with the respective intermediate transfer member is a transfer that is registered with the previous color transfer so that a four-color image formed on the receiver member has the colors in registered superposed relationship. Subsequently, the receiver member may be moved to a fuser station to fix the image to the receiver sheet. Alternatively, fixing of the image to the receiver sheet may be simultaneous with transfer of the image to the receiver sheet.

In U.S. application Ser. No. 09/474,352 there is disclosed an electrophotographic document printer and/or copier in which the photosensitive recording element comprises a photoconductive drum assembly having structure for precisely positioning the various image-processing stations relative to the drum was photoconductive surface. The drum assembly generally comprises a photoconductive drum having axles extending from opposite ends thereof along an intended axis of drum rotation and a pair of drum support members referred to as "spiders" that support the drum for rotation. Each of the drum support members has a centrally located bearing for rotatably supporting a drum axle and a plurality of mechanical fiducials (in the form of rounded buttons or "bullets") extending in an outward direction relative to the drum's axis of rotation. Each of these fiducials is adapted to engage and mate with a complementary fiducial element preferably in the form of a V-notched block, or the like, associated with one of the image-processing stations (e.g., the primary charger station or development station) as the stations are moved from a standby position substantially spaced from the drum surface towards an operative position closely spaced from or actually touching the drum surface. When the respective fiducials of the drum assembly have engaged and become seated in the V-blocks of the processing stations, the operative elements of the processing stations (e.g., the corona wires of the primary charging station, or the development brush of the toning station) will have become precisely spaced parallel to, and/or exert substantially uniform pressure on, the drum surface over the entire width of the drum.

In use, the above-described ITR drum assembly is mounted between a pair of parallel and vertically extending plates comprising the front and rear walls of the printer frame. An opening in the front plate (as viewed from the front of the printer) enables the drum assembly, as well as most of the image-processing stations, to enter the region between the plates.

Figure 2:
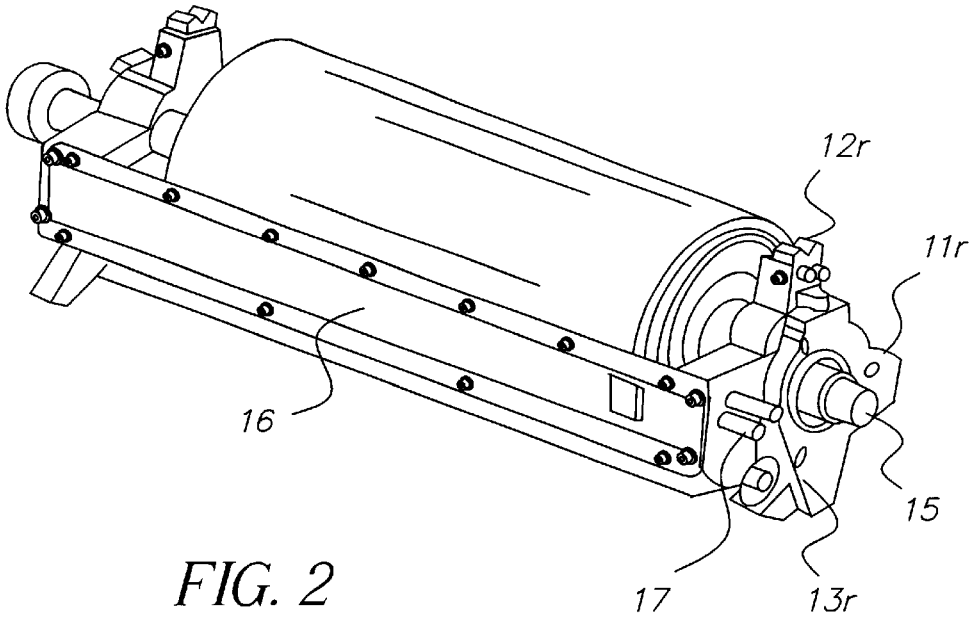
FIG. 2 is a different perspective view of the ITR drum assembly of FIG. 1 as viewed from a different orientation.

With reference to now to FIGS. 1 and 2, an ITR drum assembly is illustrated. The assembly includes a mounting spider 11*f* and 11*r* on the front and rear respectively of the drum. Terms used to designate front and rear, respectively, of the drum designate front and rear portions of the machine, wherein the axis of the ITR extends from the front to the rear and a process direction for moving an image receiving member, whether it be a continuous web or a discrete sheet is perpendicular to the axis of the ITR. In order to locate the ITR relative to the PC drum, the ITR spiders, which are rigidly connected and integrated with respective front and rear journal bearings through which the roller shaft 15 extends, include fiducial members in the form of V-blocks 12*f*, 12*r* that serve as locators for the ITR drum assembly when mounted in a printer and/or copier machine. Each V-block provides two-point contact with a bullet on the PC drum spider, as will be described below, when the two drums are engaged. Each ITR spider also provides a third point contact for locating the ITR in the form of the ITR spider's stop block 13*f*, 13*r*. The ITR, as noted above, includes the compliant blanket having a relatively hard and thin outer coating for receiving the toner image and transferring the toner image from the PC drum to a receiver member. The rail 16 connects the front and rear spiders by mounting holes in the rail onto two studs extending from each spider. A respective screw 16*bf*, 16*bb* serves to secure the rail to the spider. The rail includes top and bottom tracks 16*ct*, 16*cb* which extend front to rear of the machine. The rail 16 includes a cutout 16*a* which serves as a detent receiving recess for locking the axial position of the ITR when loaded in the machine. As may be seen in FIG. 2, the rear spider also features an electrical bias connector in the form of male plugs which extend axially from the rear spider. The male plugs are connected to brushes which electrically engage to the ITR to provide an appropriate electrical bias to the ITR for use in transfer of the toner image. The front and rear spiders are rigidly fixed to the loading rail 16, but the front spider can slightly expand axially relative to the shaft to allow thermal expansion.

Figure 3:
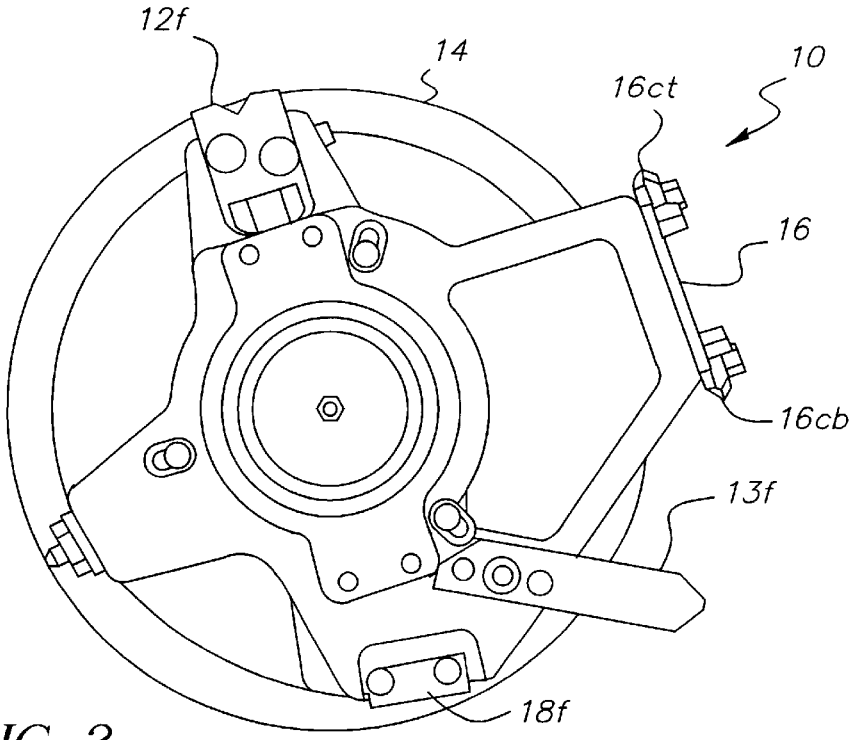
FIG. 3 is a front elevational view of the ITR drum assembly of FIG. 1 illustrating a "spider" structure at the front end of the ITR drum assembly and which spider includes various structures for locating the roller as will be described herein.
Figure 4:
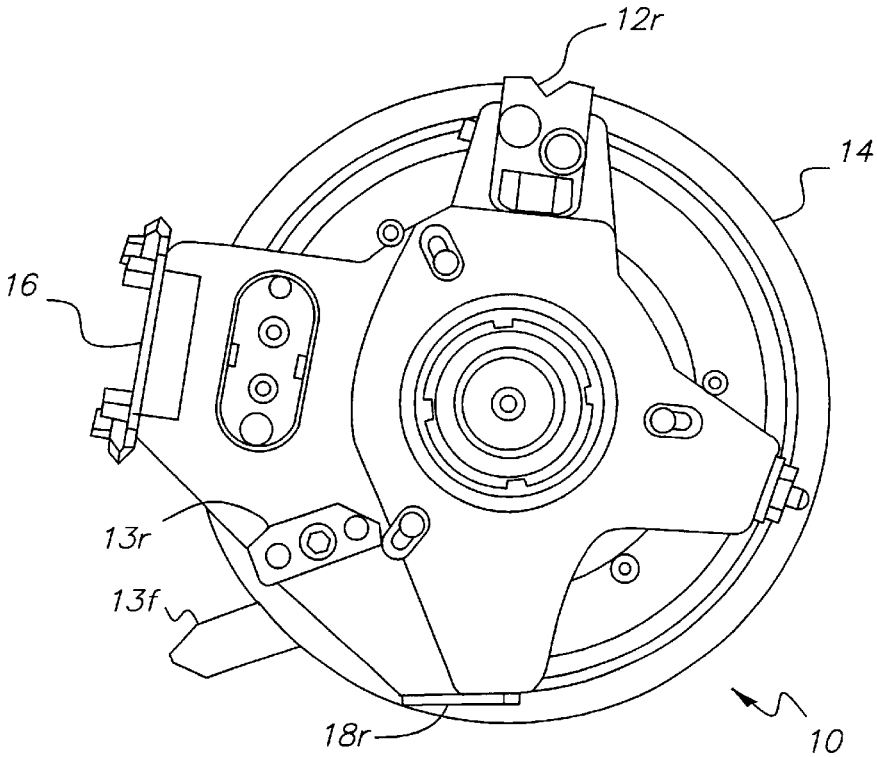
FIG. 4 is a rear elevational view of the ITR drum assembly of FIG. 1 illustrating the spider structure at the rear end of the spider.

With reference now to FIGS. 3 and 4, the elements of the front and rear spiders, respectively, are more visible there being further identified on each spider the spider push plate 18*f*, 18*r*, respectively, which are each a rigid ledge-like surface on the spider upon which a force may be impressed.

Figure 5:
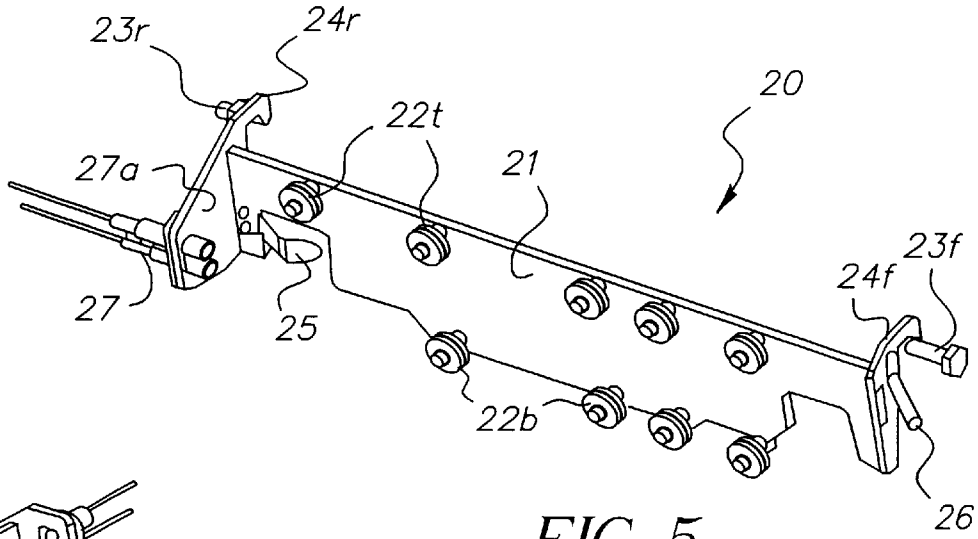
FIG. 5 is a perspective view of a carriage assembly for supporting the ITR drum assembly of FIG. 1 when the ITR drum assembly is in a disengaged position with the PC drum.
Figure 6:
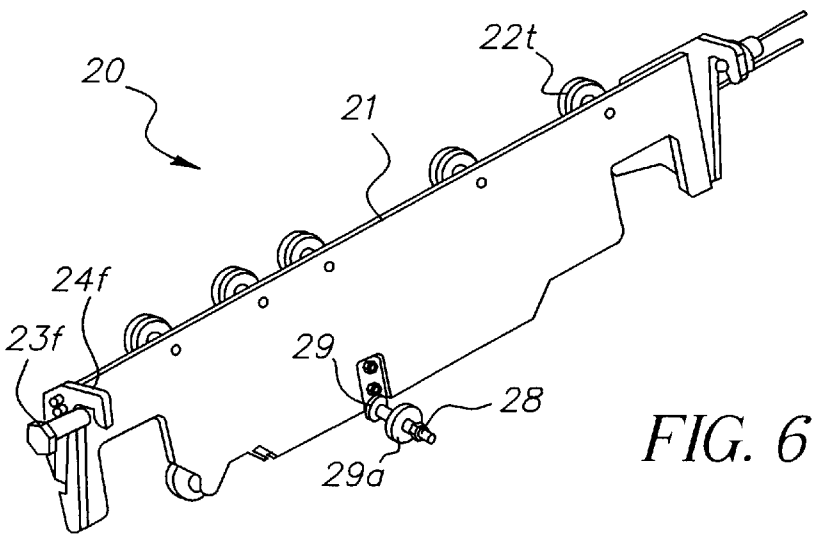
FIG. 6 is a different perspective view of the carriage assembly of FIG. 5.
Figure 7:
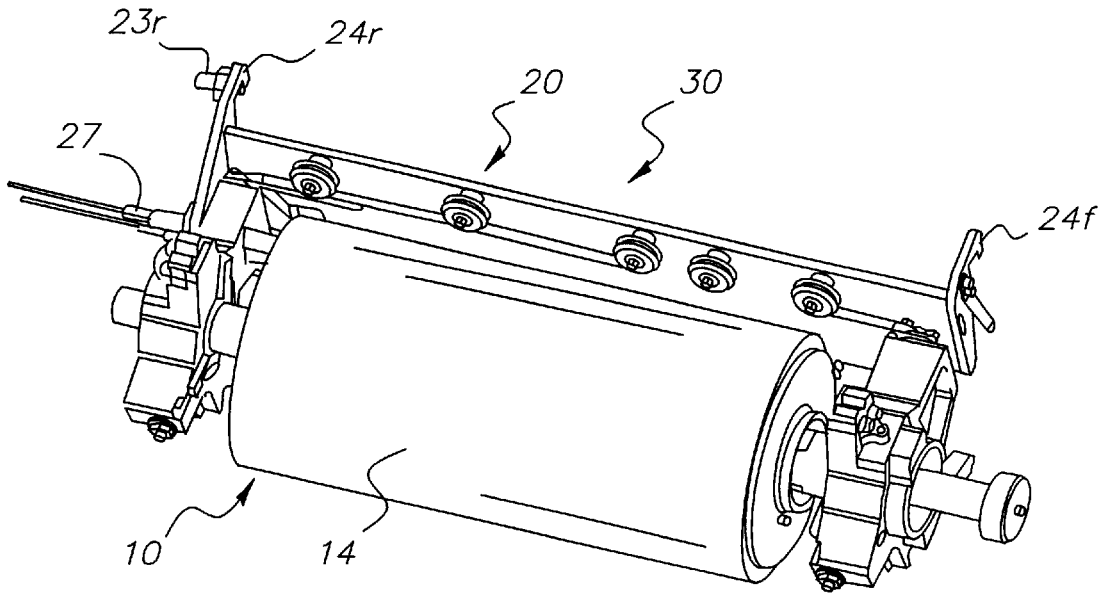
FIG. 7 is a perspective view of the carriage assembly of FIG. 5 combined with the ITR of FIG. 1 supported thereon.
Figure 8:
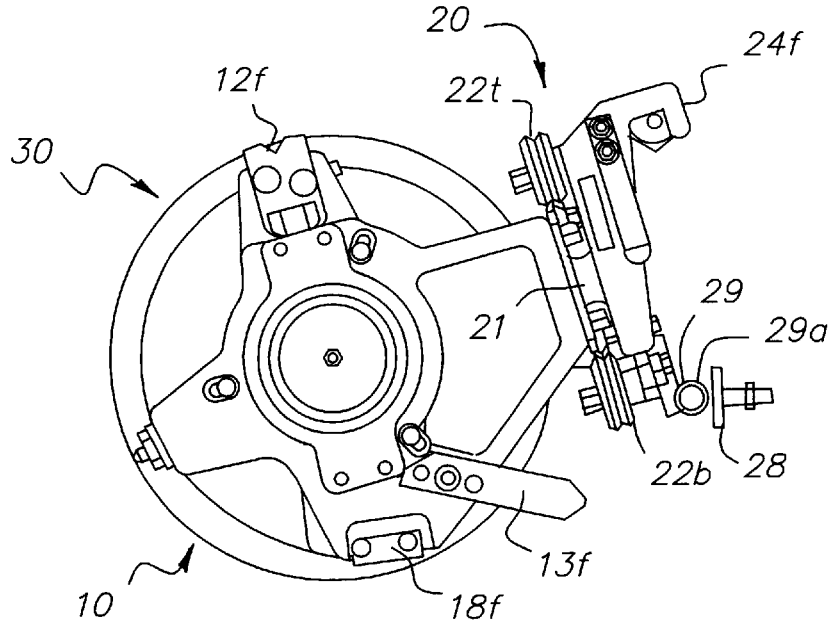
FIG. 8 is a front elevational view of the combined carriage assembly and ITR drum assembly of FIG. 7.

Reference will now be had with regard to FIGS. 5 and 6 which illustrate the ITR carriage 20. The ITR carriage supports the ITR drum assembly when the ITR drum and PC drum are not engaged. The ITR carriage 20 includes the front-to-rear extending carriage plate 21. The plate 21 supports two rows of guide rollers comprising five top and four bottom V-guide rollers 22*t*, 22*b*, respectively. A pin 23*f*, 23*r* each supports a hook 24*f*, 24*r*, respectively, that is rigidly connected to the carriage plate 21. The hooks extend perpendicular to the plate 21 and away from the ITR drum. The hooks receive the pins, and, effectively, the hooks hang from the pins 23*f*, 23*r* which mount into the frame. A detent leaf spring 25 is supported on carriage plate 21 at a position to enter a detent recess in the form of latch cutout 16*a* when the ITR drum assembly is moved axially a fixed extent. A front leaf spring 26 is mounted on the front hook. This leaf spring engages the frame and biases ITR carriage 20 rearwardly. The back of the carriage plate 21 has mounted thereto a stop rotation bracket 29 that includes a roller bearino 29*a*. The roller bearing engages a surface on a thumb screw with lock nut 28 that is connected to the frame. Since the ITR carriage is free to pivot about the pins 23*f*, 234 and pivots due to gravity, the thumb screw 28 provides, through rotation thereof, an adjustable stop position for controlling the amount of pivoting permitted when the ITR is not engaged with the PC drum. As will be noted below, this adjustability of the ITR drum assembly allows for adjustments that facilitate loading and unloading of the ITR drum assembly. A bracket at the rear of the carriage plate supports a pair of high voltage bias connectors (female) 27 for receiving the male electrical bias connectors 17 when connected, and power is applied, thus establishing an electrical bias to the supportive core of the ITR which is electrically isolated from the spiders. The bracket 27*a* has hook 24*r* formed thereon. With reference now to FIGS. 7 and 8, there is shown a combination 30 of ITR carriage 20 and IT drum assembly 10. The drum assembly 10 is mounted by axially moving the assembly into the machine, as will be described below, with the top and bottom rails 16*ct*, 16*cb* engaged, respectively, by the respective V-guide rollers 22*t*, 22*b*. As may be seen in FIG. 8, the center of gravity of the combination 30 is such that there is a tendency of the combination 30, which is supported by hooks 24*f*, 24*r*, to rotate counterclockwise about pins 23*f*, 23*r* until the roller bearing 29 engages the thumbwheel 28. The position of the thumbwheel is adjusted to a position that allows full disengagement of the ITR and PC and also orients the ITR carriage to match the orientation of the ITR loading tool carriage to be described below.

The Loading Mechanism

Figure 9:
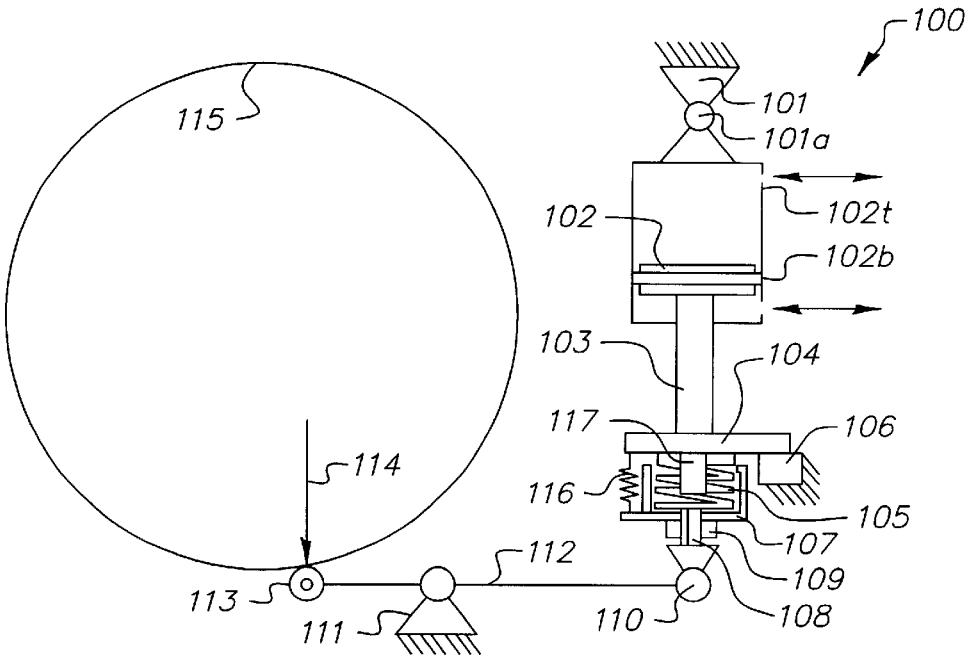
FIG. 9 is a schematic side elevational view of a mechanism for applying a load to a roller and illustrating the principal of operation of load to a roller in accordance with the method and apparatus of the invention.

Description will now be had with reference to FIG. 9 which is a schematic illustration of a mechanism or loading device 100 for applying a fixed load upon the ITR drum either directly or through a mechanical advantage, via a load lever arm 112. The spring, which is the source of the load force, can be designed to operate in tension or compression but will be described herein operating in compression as the preferred embodiment. In FIG. 9 a mount 101 on the frame is provided for pivotally supporting a double-acting pneumatic cylinder 102. The mount 101 is connected to the housing of the cylinder 102 by a pivotable connection pin 101*a*. The cylinder may, alternatively, be hydraulic fluid instead of air and, thus, generally a fluid acting cylinder. The cylinder need not be double acting but may have a return spring or rely upon the load spring to cause it to return when air is not applied to establish load. The air inputs to the doubleacting cylinder are indicated as 102*t*, 102*b*. The cylinder drives a cylinder rod 103 and bracket 104 downwardly against a stop 106 that is rigidly held by the frame. By providing for the engagement of the bracket 104 with the stop 106, any minor variations in pressure in the air cylinder are isolated from the compression spring 105, as long as the pressure in the cylinder is sufficient to retain the engagement of the bracket 104 with the frame stop 106. The spring 105 is supported in a spring cup 107 that has a threaded center hole on the bottom thereof. A threaded stud 108 is fixed at one end to pivoting cup mounting bracket 110 and is threaded into the threaded center hole at the bottom of the spring cup 107. The spring cup is rotated about the threaded stud to adjust the spring force of the spring to a predetermined force level determined previously to generate the loading force at the needle bearing 113 when the spring force is multiplied by the mechanical advantage of the lever arm. A locking nut 109 restrains the spring cup from moving relative to the threaded stud 108. The cup-mounting bracket is pivotably connected to the load lever arm 112 which is itself pivotably supported at 111 to the frame of the machine. The needle bearing 113 is located at the remote end of the arm 112 and engages a surface 114 of the spider to transmit to the spider on roller 115 any force with appropriate mechanical advantage that is applied by the spring 105. In addition to providing a mechanical advantage, the use of a lever 112 also allows for positioning of the load applying mechanism at a location so that access to the ITR from the front of the machine is not hampered by this mechanism. The location shown would position the loading mechanism between adjacent ITR drums, it being understood that no conflict with the receiver sheet path is provided, since these load applying mechanisms are outboard (front and rear) of the receiver sheet path. It is preferred to use two identical load applying mechanisms, one engaging each spider. A retaining spring 116 is connected between the spring cup and the cylinder rod end bracket, and a spring alignment stud is in the center of the spring 105 to ensure alignment of the spring 105.

Figure 10:
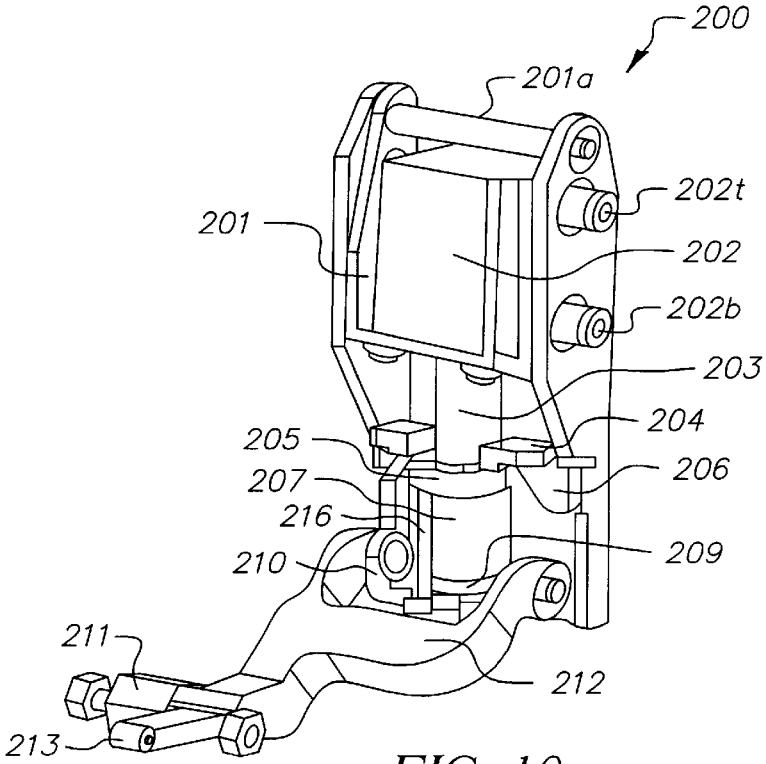
FIG. 10 is a perspective view of one of two identical mechanisms in accordance with the invention for applying a constant load force to a roller or drum in accordance with the invention.

In FIG. 10 the elements illustrated for the load applying mechanism 200 are substantially similar to that described with reference to the schematic of FIG. 9, except that corresponding parts have 100 added to them. It can be seen that cylinder 202 is mounted on a pivotable bracket 201 that pivots about pivot pin 201*a*.

Figure 11:
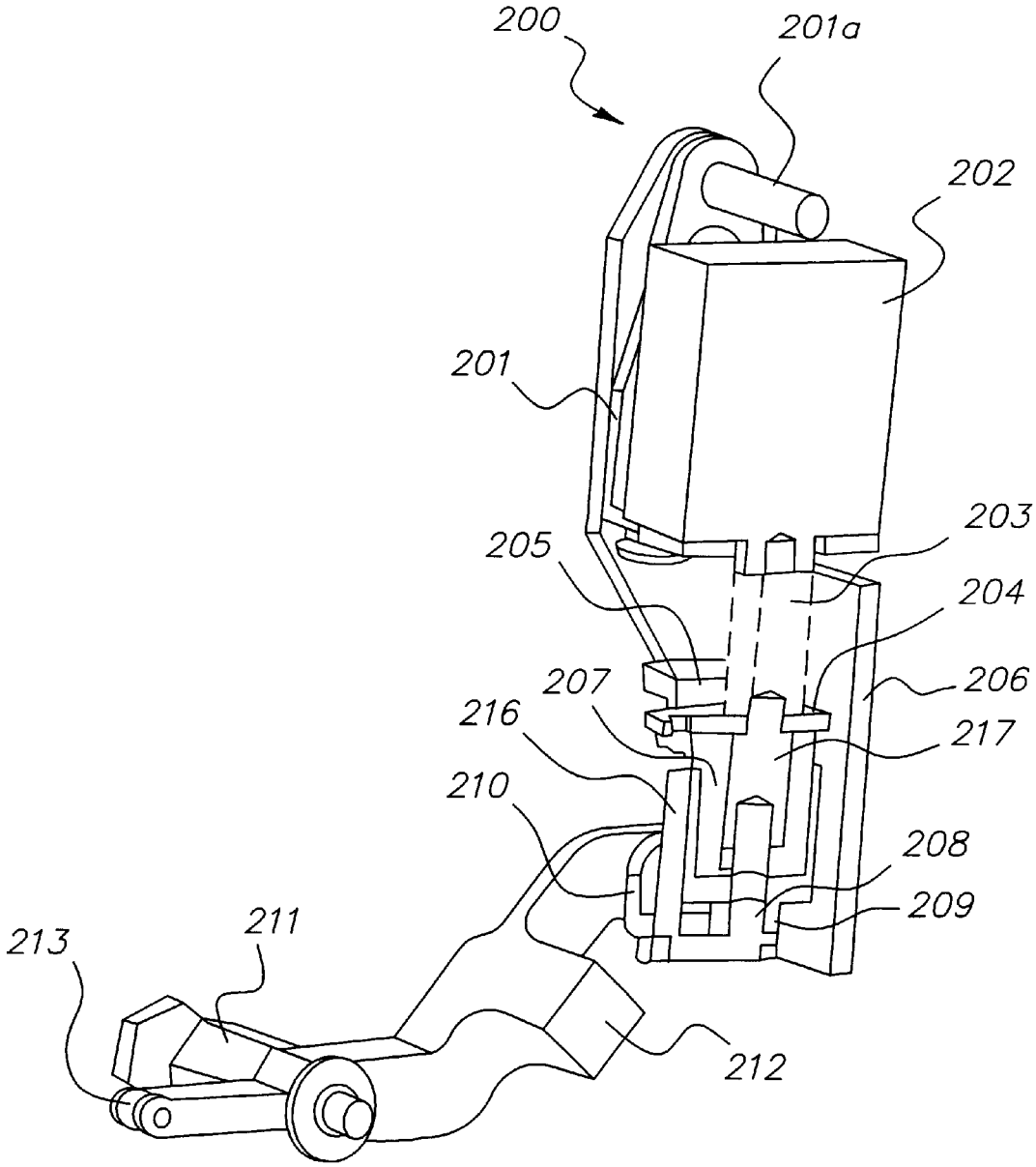
FIG. 11 is a view similar to that of FIG. 10 of the load applying mechanism of the invention but showing a portion cut away to illustrate certain elements hidden in the view of FIG. 10.

FIG. 11 is a view of the load applying mechanism 200 but showing certain parts cut away to illustrate details of the spring cup 107*b* and the threaded stud 208.

Figure 12:
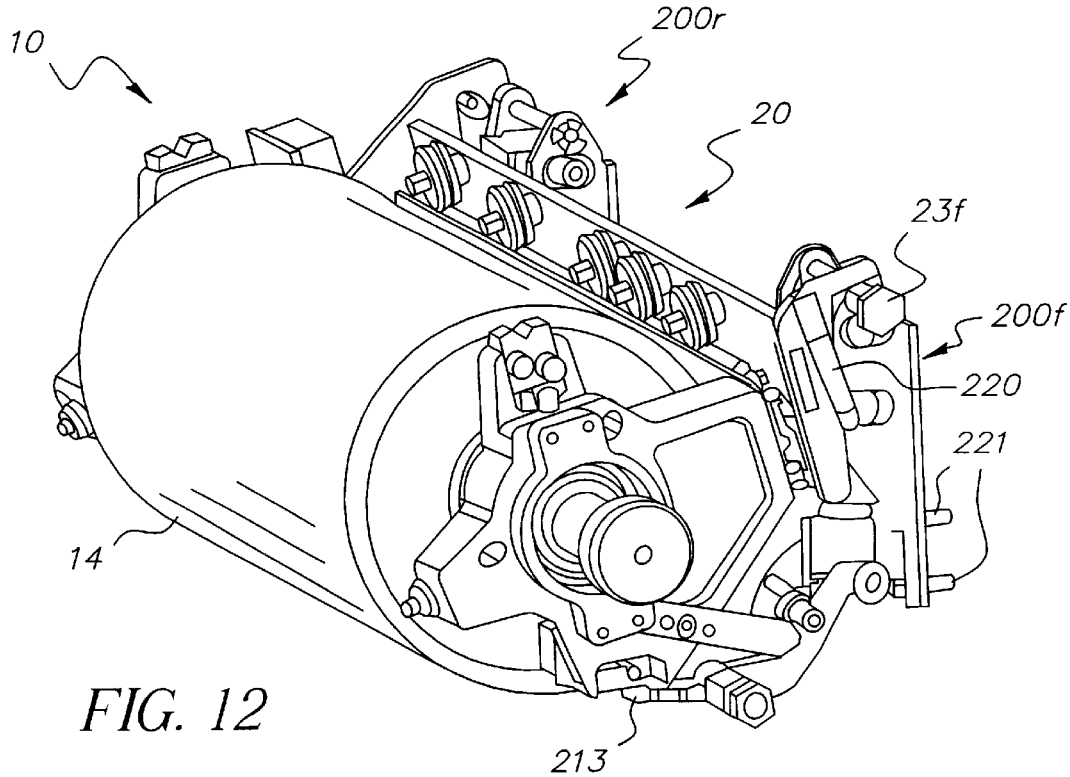
FIG. 12 is a perspective view of the combined ITR carriage assembly of FIG. 7 and additionally illustrating the two load applying mechanisms of FIG. 10.
Figure 13:
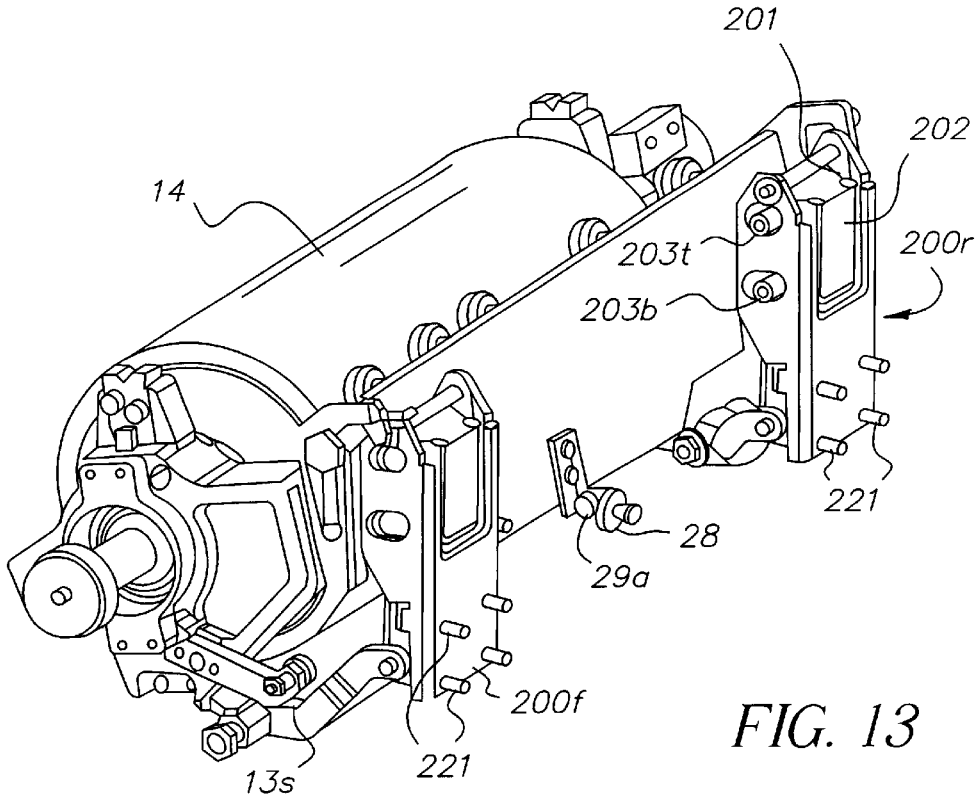
FIG. 13 is a different perspective view of the subject illustrated in FIG. 12.

FIGS. 12 and 13 are different perspective views of the combined ITR drum assembly 10, the ITR carriage 20 and the front and rear load applying mechanisms 200*f*, 200*r* showing their combination. The load lever arms are each mounted to the frame using screws 221.

Motion of ITM Drum Engagement

Figure 14:
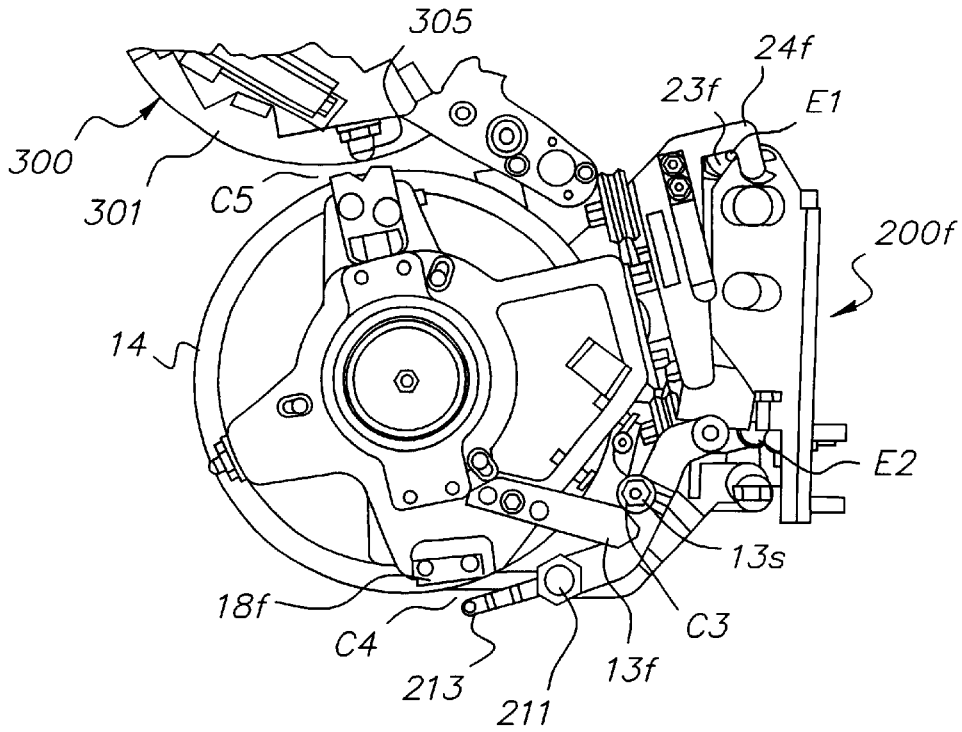
FIG. 14 is a front elevational view of the combined ITR carriage assembly and load applying mechanism and illustrating the load applying mechanism of FIG. 9 in a disengaged position.
Figure 15:
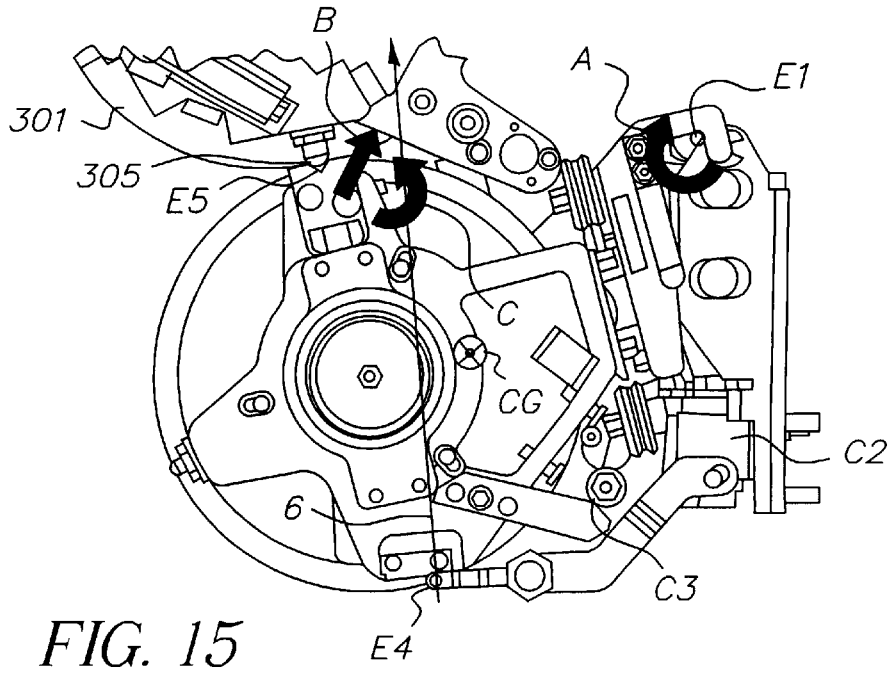
FIG. 15 is a front elevational view of the subject matter of FIG. 14 and illustrating a load being applied by the load applying mechanism but before seating of the ITR in the engaged position with the PC drum.
Figure 16:
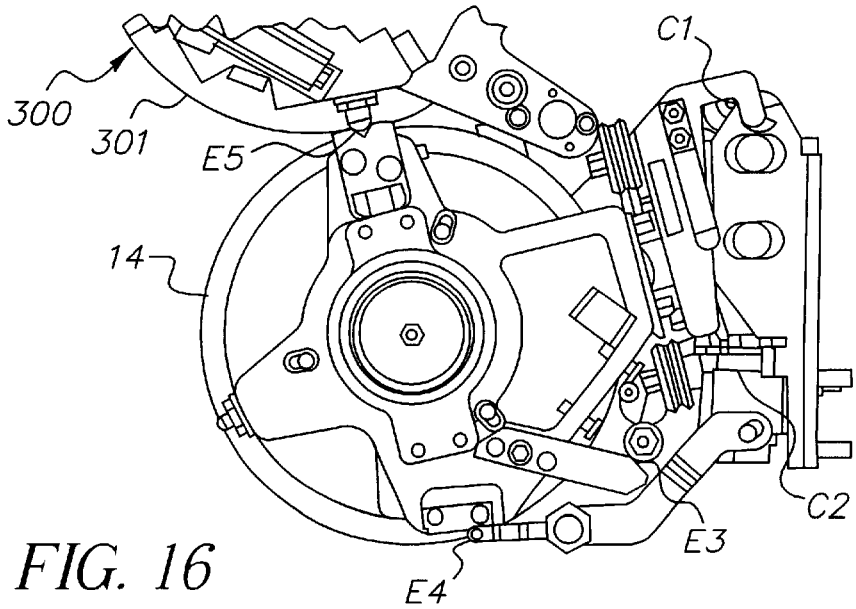
FIG. 16 is a front elevational view similar to that of FIG. 15 and illustrating the ITR in the engaged position with the PC drum.

With reference now to FIG. 14, the ITR combination comprising the combined ITR drum assembly 10, the ITR carriage 20 and the load applying mechanisms 200*f*, 200*r* are present (only 200*f* being shown), and the surface of the ITR 14 is supported out of engagement with the surface 301 of a PC drum and spider assembly 300. The ITR combination is supported at the hooks 24*f*, 24*r* by frame pins 23*f*, 23*r* and, in this disengaged position, the center of gravity of the ITR combination is such as to cause pivoting of the combination about the frame pins 23*f*, 23*r* until the roller bearing 29*a* engages the thumb screw 28. In FIGS. 14, 15 and 16, various key points are identified with an 'E' for engaged or a 'C' for clearance. In FIG. 14 the engaged point E1 represents, respectively, the engagement of the hooks 24*f*, 24*r* with the frame pins 23*f*, 23*r*, which pins now support the ITR combination. The engaged point E2 represents the engagement of the roller bearing 29*a* with the thumb screw 28. The clearance point C3 represents a clearance between the spider stop blocks 13*f*, 13*r* and a respective stop pin 13*s* fixed to the frame at the front and rear. The clearance point C4 shows a clearance between the needle bearing 213 and the spider push plate 18*f* (similar clearance provided at the rear spider). The clearance point C5 shows a clearance between a bullet on the PC spider (which spider is rigidly connected to the PC drum but allows the drum to rotate), and the V-block 12*f*, 12*r* (front-to-rear have similar clearance).

With reference now to FIG. 15, it will be noted that the load applying mechanism has been activated to cause air under pressure to enter the cylinder and commence engagement (E4) of the needle bearings 213 (front and rear) with the spider push plates 18*f*, 18*r*. A load line 6 (which is perpendicular to the spider push plate) illustrates the direction of the applied force by the needle bearing that the load line passes between the center of gravity CG of the ITR drum assembly 10 with ITR carriage 20 and the engagement E5 of the PC bullets 305 (front-to-rear) with the V-blocks 12*f*, 12*r* on the ITR's spiders. The load creates a moment (arrow A) around engagement point E1 so that the ITR combination rotates about E1. As soon as the PC spider bullets contact the respective IT spider V-blocks at the upper right edge illustrated, the ITR assembly translates up, riding on the bullet (arrow B) until the bullet nests in the vertex of the "V". The two hooks 24*f*, 24*r* now no longer engage the frame pins 23*f*, 23*r* indicated by clearance C1 in FIG. 16. When the bullet rests in the V-block, the applied force of the loading mechanism creates a moment (arrow C) around the PC bullet and the ITR combination now starts to pivot around the PC bullet until the ITR spider stop blocks 13*f*, 13*r* hit the respective stop bearings 13*s*.

In FIG. 16, there is shown the fully engaged portion of the ITR 14 with the surface 301 of the PC drum. The ITR is located by the ITR spider V-block at the PC bullet (E5) and the ITR spider stop blocks 13*f*, 13*r* engage the respective front and rear frame stop bearings 13*s* (E3). The ITR carriage hooks 24*f*, 24*r* clear one of the respective frame pins 23*f*, 23*r* (C1), and there is clearance between the carriage stop rotation bracket roller bearing 29*a* and the thumb screw 28 that is secured to the frame.

In order to insure proper nip width of the ITR-PC nip, the ITR spider V-blocks are radially adjustable and adjusted and locked in position during factory setup and/or during service. There is an overconstraint condition because of establishment of six points of engagement of the two spiders. This provides extra rigidity to the ITR drum assembly when engaged.

ITR Loading/Unloading

Figure 17:
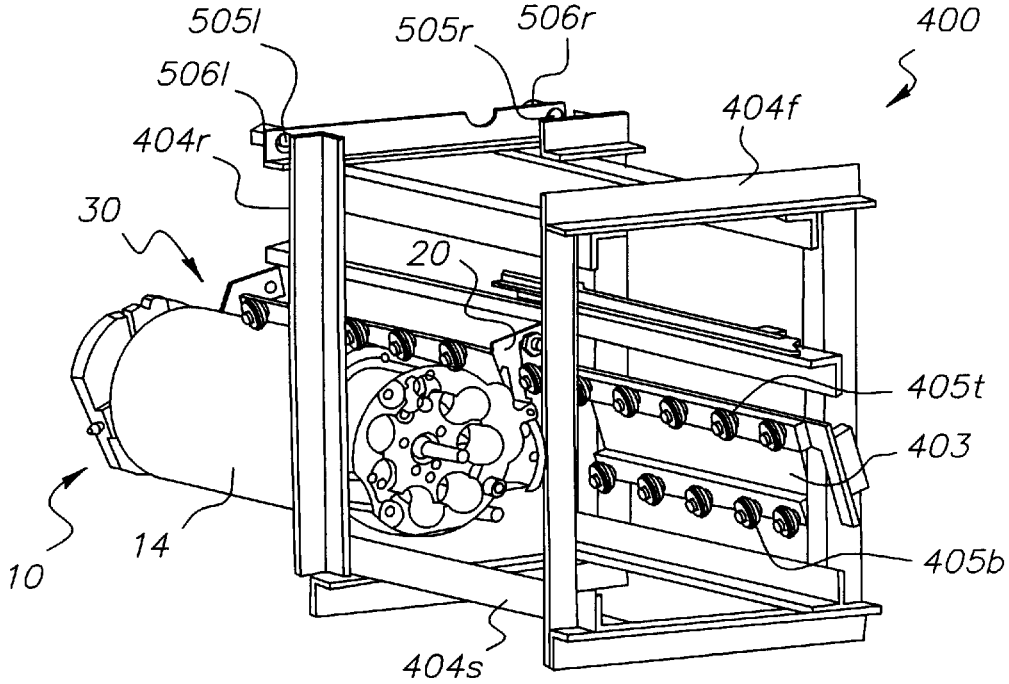
FIG. 17 is a perspective view of a loading tool for loading the ITR drum assembly to or from the reproduction apparatus in accordance with the invention.

The use of the ITR carriage facilitates loading and unloading of the ITR drum assembly 10 in the reproduction apparatus. With reference now to FIG. 17, a loading tool 400 comprises front and rear rectangular frames 404*f*, 404*r*, respectively, each formed of four right angle stock pieces. For similar stock pieces 404*s* connect the front and rear frames. The rear frame has mounting holes 505*r*, 505*l* formed therein. An ITR loading tool carriage 403 is fixed in the tool 400 and oriented and fixed at an angle identical with that to which the ITR carriage supports the ITR drum assembly 10 when the load applying mechanism does not apply its load. When loading or unloading of the ITR arm assembly 10 is to take place, the tool 400 is mounted to the locating studs (not shown) on the reproduction apparatus or machine frame by mounting the rear frame holes 505*r*, 505*l* onto the locating studs 506*r*, 506*l*. For unloading, the ITR drum assembly 10 is pulled axially forwardly from the machine, and the ITR rails 16*ct*, 16*cb* become engaged with the upper and lower V-guide rollers 405*t*, 405*b*, respectively, supported on the ITR loading tool carriage 403 because there has been kept an alignment of the ITR carriage in the machine at an identical angle to that of the loading tool carriage through adjustment of the position of the thumb screw 28. Once the ITR drum assembly 10 is completely supported by the loading/unloading tool, the tool may be lifted off the frame studs 506r, 5061 that support same and moved to carry the ITR drum assembly 10 to a location, such as a bench where it is more convenient to remove the assembly 10 from the tool and place the assembly 10 in a suitable supporting structure. Loading of an ITR drum assembly 10 is by a reverse operation wherein the assembly is placed in the tool 400 with the rail 16 of the assembly 10 supported by the ITR loading tool carriage 403. The tool 400 is then mounted on the frame loading studs 506*r*, 506*l* and the ITR drum assembly is moved axially into the machine until the rail 16 engages the ITR carriage V-guide rollers and with further rearward movement of the ITR drum assembly 10, the male electrical bias connectors engage the female connectors on the carriage and with still further rearward movement of the ITR drum assembly the detent leaf spring 25 enters the latch cutout 16*a* to lock the ITR drum assembly 10 in the machine.

Figure 18:
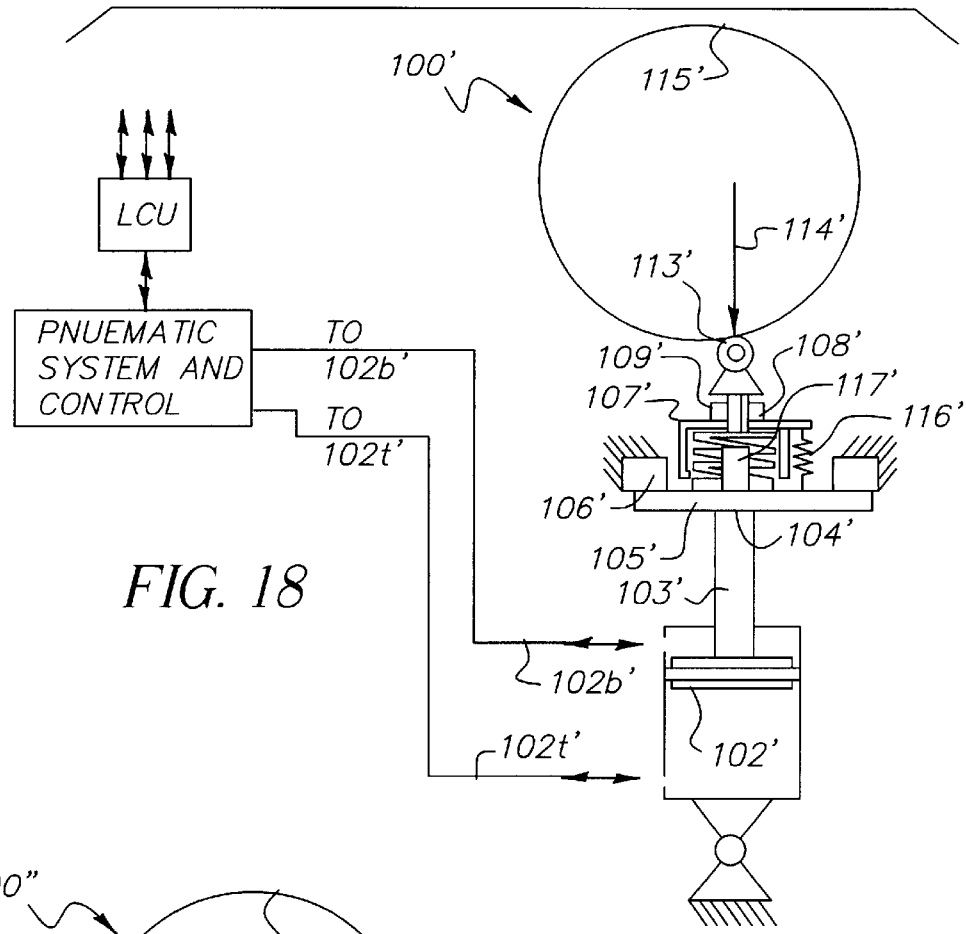
FIG. 18 is a schematic of an alternative device for applying a load to or roller or drum in accordance with the invention.

With reference now to FIG. 18, a first alternative loading mechanism embodiment is shown schematically, wherein part numbers similar to that of FIG. 9 are identified with a prime (′). The operation of the embodiment of FIG. 18 is similar to that of FIG. 9, except that no mechanical advantage is achieved, and the placement of the cylinder towards the front of the machine so as to engage a surface at the front of the ITR drum assembly to which load is to be applied is such that the apparatus provides some restrictions to access at the front of the machine. In both the apparatus of FIG. 9 and the other embodiments using air, some pneumatic source or system and control therefore is provided for controlling injection and exhaustion of air to and from the air cylinder. Overall, control may be overseen by a computer containing a logic and control unit that is programmed in response to machine cycle operation to determine when the ITR drum is to be engaged and held in engagement under pressure with the PC drum and when load is to be removed to allow movement of the ITR drum assembly to its disengaged position.

Figure 19:
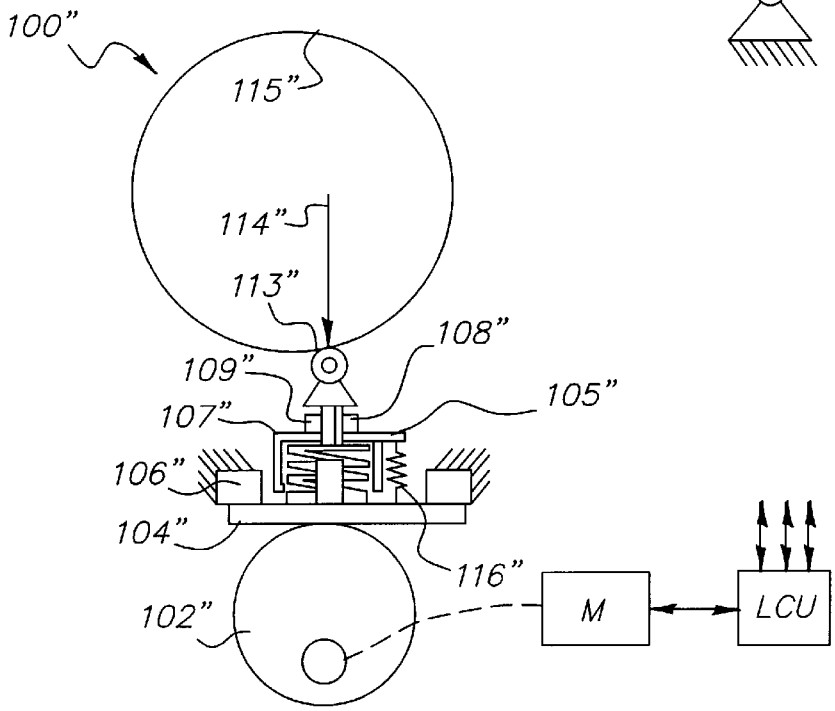
FIG. 19 is a second alternative device for applying a load to a roller or drum in accordance with the invention.

With reference now to FIG. 19, a second alternative loading mechanism embodiment is shown schematically wherein an alternative driver mechanism 102″ is substituted for the air cylinder driver 102 of FIG. 9, the mechanism 102″ being in the form of a cam being rotated by a motor M under control of the LCU. When a loading force is needed, the cam 102″ is rotated by motor M so that its high point drives the end bracket 102″ against frame stop 106″. The other structures, shown in this figure, are similar to that of FIG. 9 but identified with a double (″).

Still other alternatives include providing of a fixed stop location represented by the adjustable thumbscrew 28. An adjustable positioning could then be provided for in the loading tool carriage. However, for a machine with multiple image forming modules and thus multiple ITR drum assemblies and ITR carriages, it is preferred to have the adjustable thumb screw stop be provided for the machine's ITR carriages.

In the embodiments of FIGS. 18 and 19, movement of the threaded stud 108′, 108″ is preferably constrained by suitable structure so that movement is limited to back and forth movement in the vertical direction shown and lateral movement is blocked.

In the various embodiments, the loading force is of a sufficient extent to ensure proper engagement of the bullets with V-blocks, and the spider stop blocks with frame stop bearings. The summation of the forces on the ITR should not overcome this proper engagement. The location of the load line 6 between the center of gravity CG (as diagramed in FIG. 15) and the V-block fiducial insures that the bullet will enter the V-groove as a rotational movement is established about E1 (the carriage hooks on their respective frame pins). The loading force should not be so large that it deforms the bullet. In still another alternative, the bullet could be on the ITR and the V-block on the PC drum. There may be a need with such modification to change location of the hook engagement E1.

The invention has been described with regard to an ITR moving to engage a PC drum, but it is also contemplated that the moveable drum need not be an ITR but could be a photoconductor or other drum in a printing apparatus providing movement or load application in accordance with the teachings herein. The invention has been described in detail with particular reference to preferred embodiment thereof, but it will be understood that variations and modifications can be effected within the spirit and scope of the invention.

| Parts List | |
|---|---|
| 6 | load line |
| 10 | ITR drum assembly |
| 11f, 11r | spider front/rear |
| 12f, 12r | V-block front/rear |
| 13f, 13r | spider stop block |
| 13s | frame stop bearing |
| 14 | ITR with blanket |
| 15 | ITR shaft |
| 16 | ITR rail |
| 16a | latch cutout |
| 16bf, 16bb, 16ct, 16cb | screws front/back rail tracks top/bottom |
| 17 | electrical bias connectors - male |
| 18f, 18r | spider push plate front/rear |
| 20 | ITR carriage |
| 21 | carriage plate |
| 22t, 22b | V-guide rollers top/bottom |
| 23f, 23r | frame pin front/rear |
| 24f, 24r | carriage hook |
| 25 | detent leaf spring |
| 26 | front leaf spring |
| 27 | high voltage bias connectors female |
| 27a | bracket |
| 28 | thumb screw with lock nut |
| 29 | stop rotation bracket with roller bearing |
| 29a | roller bearing |
| 30 | combination of ITR carriage 20 and IT drum assembly |
| 10 | |
| 100, 100′, 100″, 200f, 200r | (front/rear load applying mechanism schematic drawing/detailed drawing) |
| 101, 201 | mount for cylinder |
| 101a, 201a | pivot pin for cylinder mount |
| 102, 102′, 202 | double-acting pneumatic cylinder |
| 102t, 102b, 102t′, 102b′, 202t, 202b | input-output to pneumatic cylinder |
| 103, 103′, 203 | cylinder rod |
| 104, 104′, 204 | cylinder rod end bracket |
| 105, 105′, 205 | compression spring |
| 106, 106′, 206 | hard stop on frame |
| 107, 107′, 207 | spring cup with threaded center hole on the bottom |
| 108, 108′, 208 | threaded stud |
| 109, 109′, 209 | locking nut |
| 110, 210 | stud mount for load lever arm |
| 112, 212 | load lever arm |
| 113, 113′, 213 | needle bearing |
| 114, 114′ | nominal position of engaged spider |
| 115, 115′ | ITR drum and spiders |
| 116, 116′, 216 | cup retaining spring |
| 117, 117′ | spring alignment stud |
| 221, | load lever arm mounting screws |
| 300, | PC drum and spider assembly |
| 301, | surface of the PC drum |
| 305, | bullet |
| 400, | ITR drum loading/unloading tool |
| 403 | ITR loading tool carriage |
| 404f, 404r | frame elements |
| 405t, 405b | V-guide rollers top/bottom |
| 505r, 505l | mounting holes at rear of frame |
| 506r, 506l | locating studs on front frame |
| Engagement Points | |
| E1 | pivot of carriage assembly hook |
| E2 | carriage assembly stop |
| E3 | spider stop block |
| E4 | load applying to spider |
| E5 | PC bullet - spider V-block |
| Clearance Points | |
| C1 | pivot of carriage assembly hook |
| C2 | carriage assembly stop |
| C3 | spider stop block |
| C4 | load applying to spider |
| C5 | PC bullet - spider V-block |
| CG | center of gravity of ITR drum assembly and ITR carriage |

What is claimed is:

1. For use with a printing apparatus having a roller assembly used for printing, a method of loading the roller assembly into the printing apparatus, the method comprising:

supporting the roller assembly in a loading tool having a first carriage with top and bottom rows of rollers, the rollers engaging rails on the roller assembly and the first carriage being oriented with a second carriage within the printing apparatus, the second carriage also having top and bottom rows of rollers;

moving the roller assembly into the machine so that rails of the roller assembly are engaged by the rollers of the second carriage in the printing apparatus;

adjusting the roller assembly angle; and removing the roller assembly from the tool and placing the roller assembly within the second carriage.

2. A loading tool for loading a roller used in a printing apparatus, the loading tool comprising:

a frame and carriage supported within the frame, the carriage comprising a set of top and bottom rows of rollers oriented to match an orientation of a similar set of rollers of a carriage in the printing apparatus; and an orientation mechanism attached to the roller that can correctly match the roller angle on the loading tool to that angle for the roller within the printing apparatus.

3. For use with a printing apparatus having a roller assembly used for printing, a method of loading the roller assembly into the printing apparatus, the method comprising:

supporting the roller assembly in a loading tool having a first carriage with roller assembly supporting elements of the first carriage having a predetermined orientation;

providing a second carriage within the printing apparatus having roller assembly supporting elements similar to that of the first carriage, the orientation of the roller assembly supporting elements of the second carriage being adjustable and adjusting the orientation of the second carriage to adjust the elements of the second carriage to that of the elements of the first carriage; and moving the roller assembly into the machine so that the roller assembly is engaged by the supporting elements of the carriage in the printing apparatus.

4. The method of claim 1 wherein the step of adjusting further comprises adjusting a mechanism that is placed on the roller assembly.

5. The tool of claim 2 wherein the orientation mechanism is an adjustment mechanism that is placed on the roller assembly.

6. The method of claim 3 wherein the adjusting within the providing step is accomplished by adjusting a screw mechanism on the roller assembly supporting elements.

* * * * *